US008573360B1

(12) United States Patent
Yoder

(10) Patent No.: US 8,573,360 B1
(45) Date of Patent: Nov. 5, 2013

(54) ROOF JACKING SEAT SYSTEM

(76) Inventor: Mervin Yoder, Canton, OH (US)

( * ) Notice: Subject to any disclaimer, the term of this patent is extended or adjusted under 35 U.S.C. 154(b) by 85 days.

(21) Appl. No.: 13/291,133

(22) Filed: Nov. 8, 2011

(51) Int. Cl.
*E04G 3/00* (2006.01)
*E04D 15/00* (2006.01)

(52) U.S. Cl.
USPC ..... 182/45; 52/749.12

(58) Field of Classification Search
USPC ..... 182/45; 52/749.12; 248/237
See application file for complete search history.

(56) References Cited

U.S. PATENT DOCUMENTS

| | | | | | |
|---|---|---|---|---|---|
| 955,159 | A * | 4/1910 | Hillmon | 182/45 |
| 2,320,538 | A * | 6/1943 | Vogt | 182/45 |
| 3,866,715 | A * | 2/1975 | Foulk | 182/45 |
| 4,398,620 | A * | 8/1983 | Townsend | 182/45 |
| 5,318,148 | A * | 6/1994 | Franco et al. | 182/45 |
| 5,320,194 | A * | 6/1994 | Bredijk | 182/45 |
| 5,730,407 | A * | 3/1998 | Ostrobrod | 248/237 |
| D485,657 | S * | 1/2004 | Lewis et al. | D34/28 |
| 6,745,869 | B2 * | 6/2004 | Garrett | 182/45 |
| 8,240,683 | B1 * | 8/2012 | Haslup, Sr. | 280/47.29 |

* cited by examiner

*Primary Examiner* — Alvin Chin Shue

(57) ABSTRACT

The roof jacking seat system is inclusive of a seat pivotally oriented with respect to a wheeled frame such that said seat can adjust in accommodation of different roof pitches. The system is for the support of an end user atop of said roof during roof shingle removal processes. The frame includes a winching means having a cable and hook for engagement onto a roof ridge such that the entire system may be driven up or down a side of said roof. The frame includes a plurality of wheels in parallel orientation thereby enabling movement along a single axis. Pivoting means enables adjustment of the seat at different angles with respect to the frame. The frame may include along a distal end, a footrest for use by the end user.

1 Claim, 5 Drawing Sheets

ROOF JACKING SEAT SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of roofing, more specifically, a seat for use by a person in removal of roofing.

Roofing is a hard job, especially in the heat. In repairing and replacing a roof it is often needed to remove roofing shingles from the roof structure. The task of removing shingles from a roof is a labor-intensive process that can be dangerous. Removing roofing shingles is often accomplished by use of a shingle remover tool, which resembles a shovel. In removing shingles via the shingle remover tool, an end user must balance him/herself on the pitch of the roof while pushing/kicking the tool in order to un-nail the roofing shingle from the roof. This process can be pain staking, and cause back pain and strain. Over the years, many devices have come available that assist the end user as a safety measure in order to balance oneself on the pitch of the roof.

However, no device has offered a seat system that can mechanically raise and lower itself, and which has a pivoting seat that can be adjusted according to a pitch of a roof. The device of the present application seeks to overcome the needs of an end user in removing roof shingles.

B. Discussion of the Prior Art

As will be discussed immediately below, no prior art discloses a roof jacking seat system for use by an end user as a roof jacking seat system for use by an end user as a seat when removing roof shingles from a roof whereby the jacking system includes a mechanical winch or winching means having a cable with a hook for attachment to the ridge of a roof; wherein the seat is pivotably adjustable with respect to a wheeled frame; wherein the frame includes a plurality of said wheels that enable movement of the frame along a single axis either upwardly or downwardly with respect to a side of the roof; wherein an end user can adjust the angle of the seat with respect to the frame via pivoting means thereby accommodating different roof pitches.

The Ostrobod Patent (U.S. Pat. No. 5,730,407) discloses a roof anchoring system with a safety line. However, the roof anchoring system does not feature a seat including a mechanical winch that extends a cable to a hook for attachment to the hooks onto the ridge of a roof The Bredijk Patent (U.S. Pat. No. 5,320,194) discloses an adjustable roofing scaffold apparatus arranged for mounting to a roof. However, the scaffold is not a pivoting seat system that includes a mechanical winch for moving a frame assembly up or down a side of a roof thereby offering a seat onto which an end user may remove shingles therefrom.

The Garrett Patent (U.S. Pat. No. 6,745,869) discloses an adjustable ladder and scaffold support for a roof. However, the adjustable ladder and scaffold is not a seat that pivots about a frame in order to adjust for roof pitch, and which includes wheels and a mechanical winch for driving the device up or down a side of a roof, and which aids an end user in removing shingles from a roof.

The Townsend Patent (U.S. Pat. No. 4,398,620) discloses an apparatus for supporting a working platform on a roof. Again, the working platform is not a seat that can pivot with respect to a wheeled frame in order to accommodate roof pitch, and which includes a mechanical winch for driving said seat up or down a side of a roof thereby aiding an end user in roofing shingle removal.

The Foulk et al. Patent (U.S. Pat. No. 3,866,715) discloses an adjustable roofing platform for a pitched angle roof. However, the adjustable roofing platform is not a wheeled assembly featuring a mechanical winch for driving up or down a side of a roof, or that includes a pivoting seat for accommodation of different roof pitches thereby aiding an end user in removal of roofing shingles.

The Lewis et al. Patent (U.S. Pat. No. Des. 485,657) illustrates an ornamental design for a roofing apparatus, which does not depict a winching means or pivoting seat assembly.

While the above-described devices fulfill their respective and particular objects and requirements, they do not describe a roof jacking seat system for use by an end user as a seat when removing roof shingles from a roof whereby the jacking system includes a mechanical winch or winching means having a cable with a hook for attachment to the ridge of a roof; wherein the seat is pivotably adjustable with respect to a wheeled frame; wherein the frame includes a plurality of said wheels that enable movement of the frame along a single axis either upwardly or downwardly with respect to a side of the roof; wherein an end user can adjust the angle of the seat with respect to the frame via pivoting means thereby accommodating different roof pitches. In this regard, the roof jacking seat system departs from the conventional concepts and designs of the prior art.

SUMMARY OF THE INVENTION

The roof jacking seat system is inclusive of a seat pivotally oriented with respect to a wheeled frame such that said seat can adjust in accommodation of different roof pitches. The system is for the support of an end user atop of said roof during roof shingle removal processes. The frame includes a winching means having a cable and hook for engagement onto a roof ridge such that the entire system may be driven up or down a side of said roof. The frame includes a plurality of wheels in parallel orientation thereby enabling movement along a single axis. Pivoting means enables adjustment of the seat at different angles with respect to the frame. The frame may include along a distal end, a footrest for use by the end user.

An object of the invention is to provide a seat system that supports a person on a side of a roof during the roofing shingle removal process.

A further object of the invention is to provide a seat that is pivotably engaged with respect to the frame such that the seat can adjust for different roof pitches.

A further object of the invention is to provide a frame that includes wheels in general alignment with one another, such that the frame can move along a single axis.

An even further object of the invention is to provide a winching means with said frame such that the entire device can move up or down the side of the roof.

An even further object of the invention is to provide the winching means with a cable and hook, which attach onto the roof ridge.

A further object of the invention is to provide a winching means that is remotely powered, and relatively lightweight in order to aid in portability of the invention.

A further object of the invention is to offer a footrest on a distal end of the frame so as to enable a surface onto which an end user may rest one or all feet while seated thereon.

These together with additional objects, features and advantages of the roof jacking seat system will be readily apparent to those of ordinary skill in the art upon reading the following detailed description of presently preferred, but nonetheless illustrative, embodiments of the roof jacking seat system when taken in conjunction with the accompanying drawings.

In this respect, before explaining the current embodiments of the roof jacking seat system in detail, it is to be understood that the roof jacking seat system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roof jacking seat system.

It is therefore important that the claims be regarded as including such equivalent construction insofar as they do not depart from the spirit and scope of the roof jacking seat system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
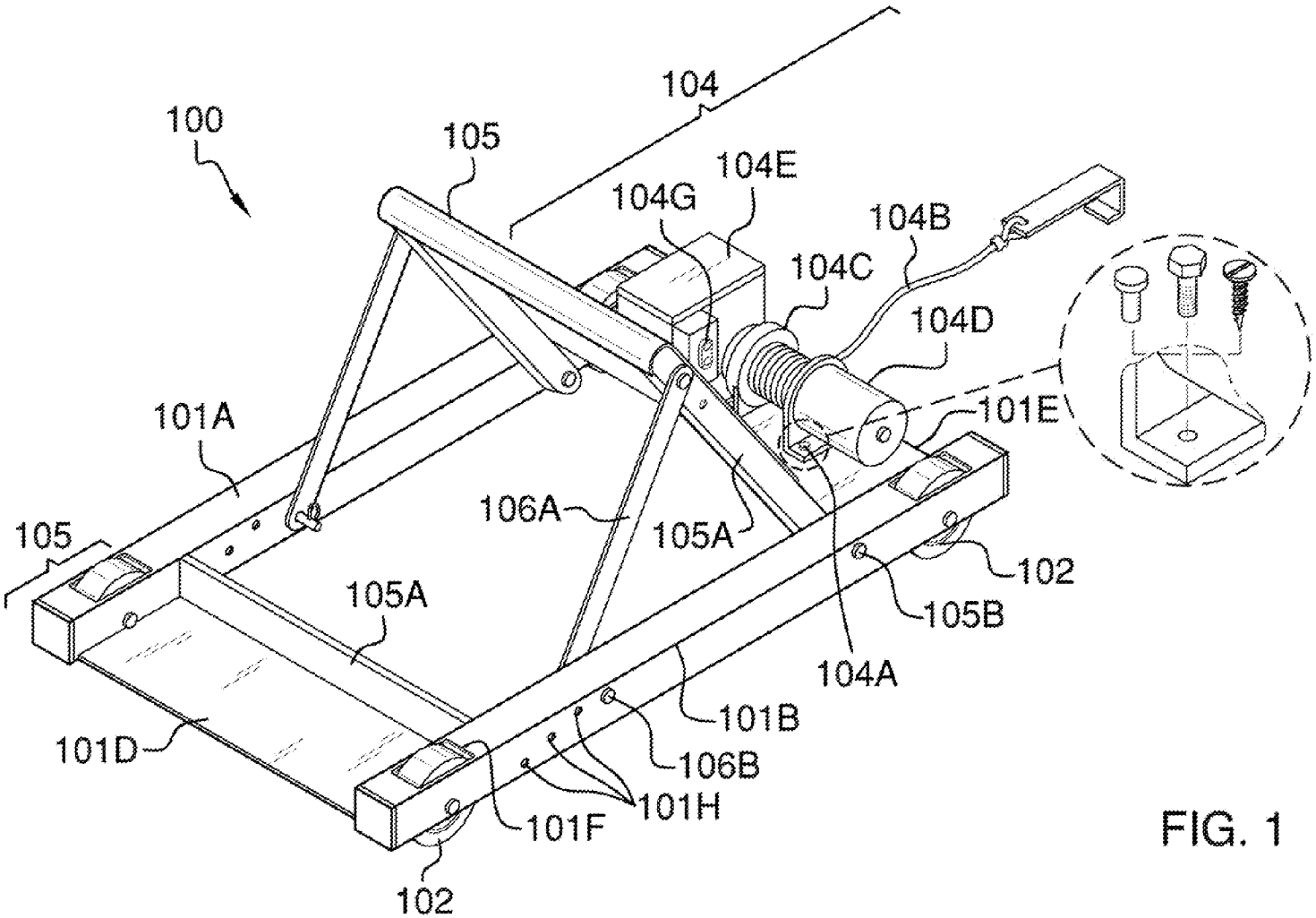
FIG. 1 illustrates a perspective view of the roof jacking seat system by itself in which the winching means depicts a cable and hook extending therefrom while further detailing the seat oriented acutely with respect to the side of the frame including the winching means.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A roof jacking seat system 100 (hereinafter invention) includes a frame 101 that may be referred to as a wheeled frame. The frame 101 includes a plurality of wheels 102, which are generally aligned with one another. The plurality of wheels 102 is capable of movement along a single axis 103. The single axial 103 movement of the wheels 102 enables movement of the invention 100 up or down a side of a roof 130.

The frame 101 is further defined with a first member 101A and second member 101B that are separated by a distance 101C. The first member 101A and the second member 101B are both connected to a third member 101D and a fourth member 101E. Both the third member 101D and the fourth member 101E define distal ends of the frame 101. The third member 101D acts as a footrest 105 (see FIG. 5); whereas the fourth member 101E provides a place onto which winching means 104 is mounted.

The first member 101A and the second member 101B each have wheel wells 101F provided therein, which are essentially holes into which the wheels 102 are situated. It is important to note the placement of the wheels 102 with respect to the frame 101 shall be closest to the distal ends thereby forming as broad a wheel base as is possible with respect to the distance 101C, which thereby aids in the prevention of unwanted rolling of the invention 100 to either side.

The footrest 105 is further defined with a vertical member 105A that acts as a heel stop in order to prevent an end user 140 from placement of a foot 141 between the third member 101D and the fourth member 101E.

The winching means 104 is mounted to the frame 101 via securing means 104A comprising welding, bolting, screwing, or riveting the winching means 104 to the fourth member 101D. The winching means 104 includes an electronic winch having a cable 104B wound upon a spindle 104C in mechanical communication with a motor 104D. The cable 104B is of an undefined length, and includes a hook 104D at a distal end of said cable 104B. The hook 104D is used to hook onto a roof ridge 131 (see FIG. 5).

Figure 3:
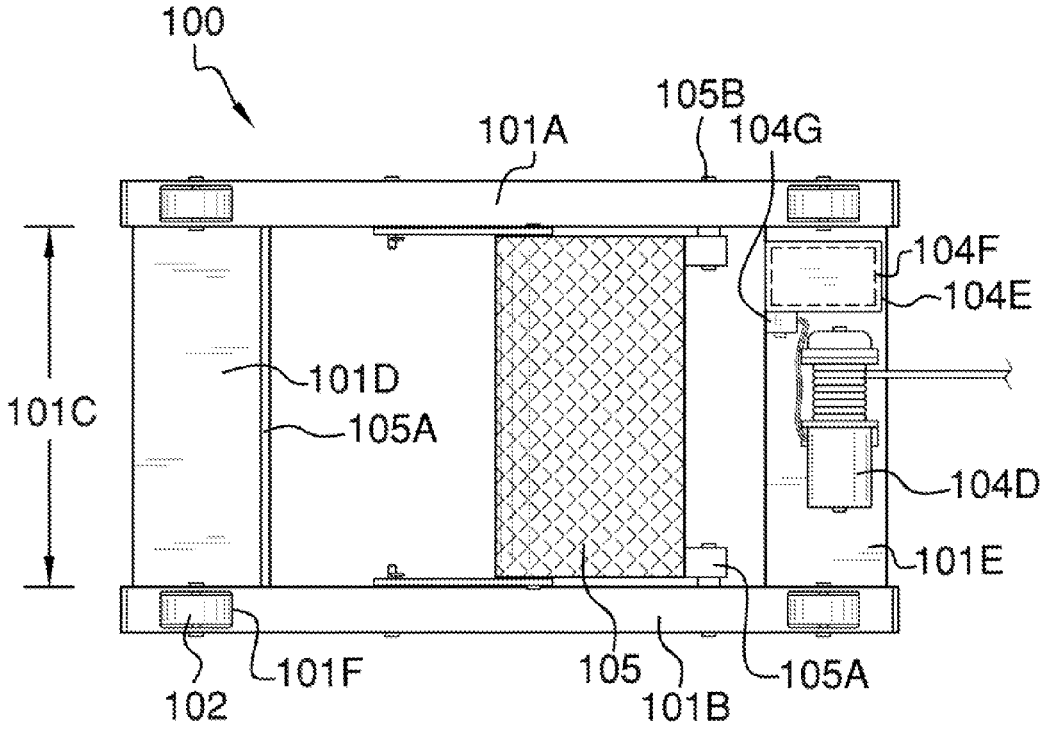
FIG. 3 illustrates a top view of the roof jacking seat system in which the cable of the winching means is extended from the wheeled frame while detailing the construction of the wheeled frame with respect to the wheels, and further noting the powering means in wired communication with respect to the winching means.
Figure 4:
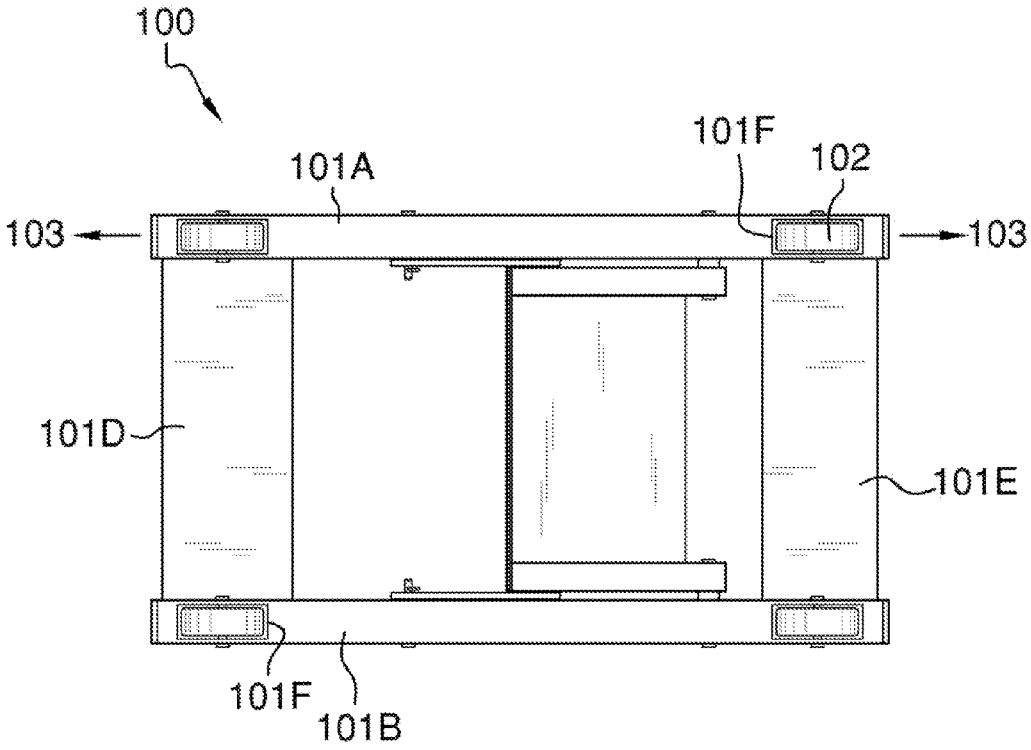
FIG. 4 illustrates a bottom view of the roof jacking seat system.
Figure 5:
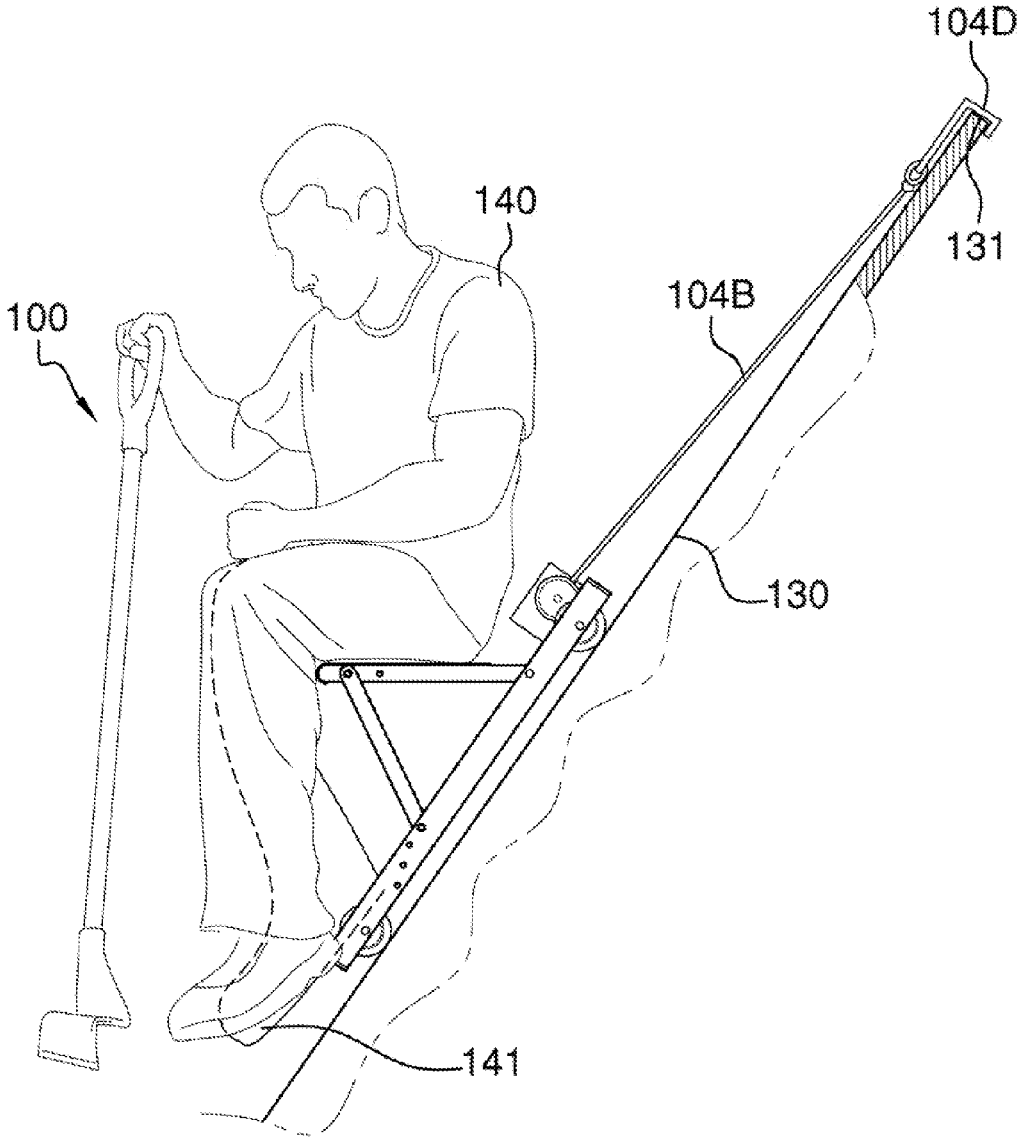
FIG. 5 illustrates a side view of the roof jacking seat system in use upon a side of a roof in which the winching means has the cable extended therefrom while an end user is seated upon the seat that is generally parallel with a level surface, and further noting a foot placed onto the footrest.

The motor 104D is in wired communication with a powering means 104F, which is comprised of at least one battery that is stored within a housing 104E (see FIG. 3 in which the battery is inside of the housing 104E). The winching means 104 includes a control switch 104G that essentially powers the motor 104C to wind or unwind the cable 104B thereon. Wiring extends from the control switch 104G to the motor 104C (see FIG. 3).

The invention 100 includes a seat 105 that attaches to the frame 101. The seat 105 includes seat members 105A that each attaches to either the first member 101A or the second member 101B via a pivoting point 105B. Pivoting means 106 attach to the seat members 105A, and enable the seat 105 to pivot at varying angles 150 with respect to the frame 101 (see FIG. 2), and more importantly the roof 130.

The pivoting means 106 are pivoting arms 106A that attach to seat holes 105C of the seat members 105A opposite of the pivoting point 105B. The pivoting arms 106A each include a locking pin 106B, which can selectively engage holes 101H provided on both the first member 101A and the second member 101B thereby forming said varying angles 150 between the seat 105 and the frame 101.

Figure 1A:
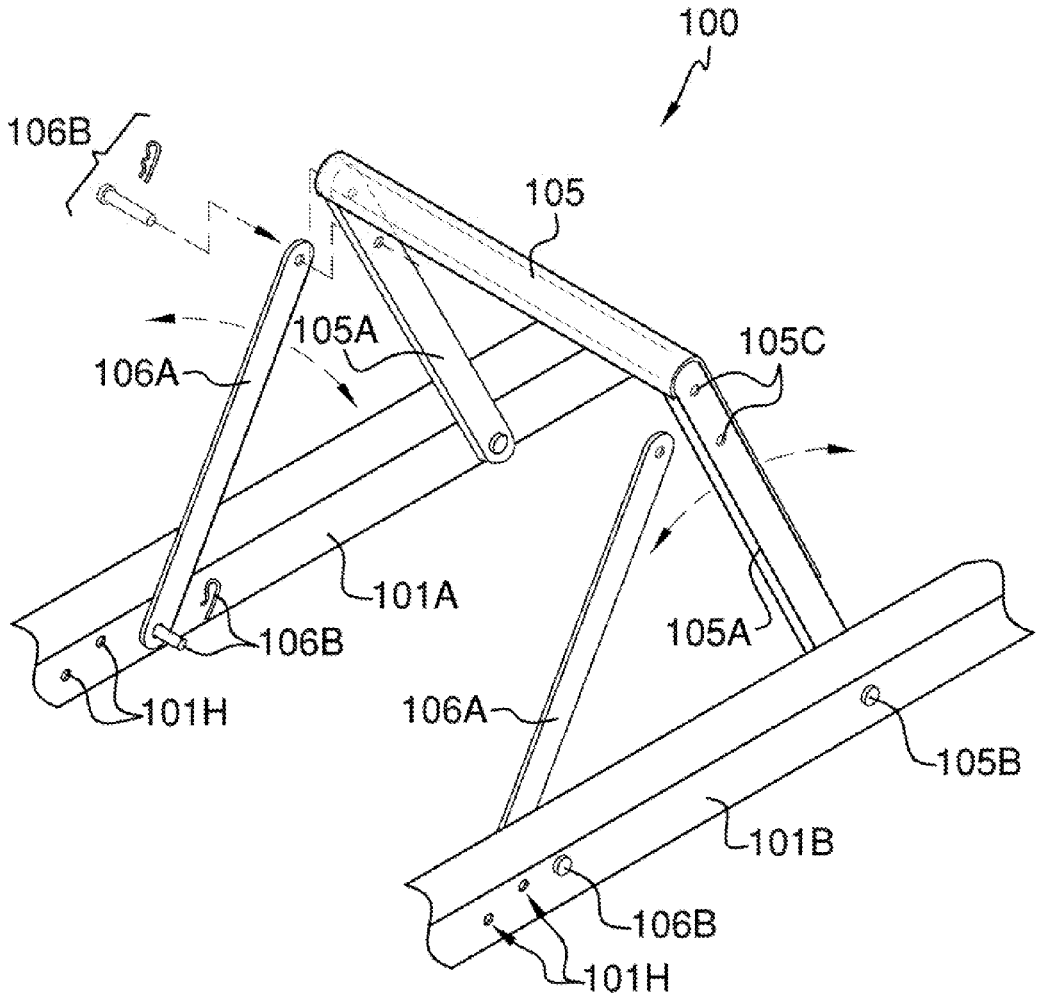
FIG. 1A illustrates the locking pins used to secure and enable rotation of both the seat and pivoting arms with respect to the frame as well as with respect to each other.
Figure 2:
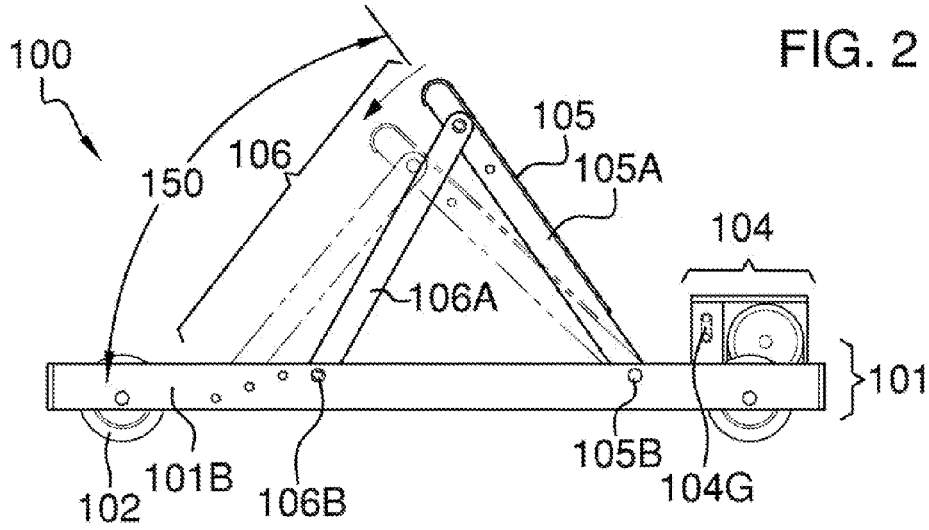
FIG. 2 illustrates a side view of the roof jacking seat system by itself in which an arrow depicts rotation of the seat with respect to the wheeled frame via the pivoting means.

Referring to FIG. 1A, it shall be noted that locking pins 106B shall be used to attach and enable rotation of the seat members 105A with respect to the frame 101, attach and enable rotation of the pivoting arms 106A with respect to the frame 101, and to lock the seat members 105A to the pivoting arms 106A. It shall be further noted that there are a multitude of different styles of locking pins 106B, which may or may not include a cotter pin completely separable with respect to the locking pin 106B.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A roof jacking seat system comprising:

a seat pivotally engaged with respect to a wheeled frame having winching means for driving said frame along a single axis on a roof surface;

wherein pivoting means enable adjustment of said seat with respect to a roof pitch;

wherein said seat is suited for supporting an end user upon said roof while removing shingles there from;

wherein the wheel frame is further defined with a first member and a second member separated by a distance; wherein the first member and the second member each attach to a third member and a fourth member; wherein the third member and the fourth member form distal ends of the wheel frame;

wherein the third member includes a footrest thereon whereas the winching means includes a winch mounted on the fourth member;

wherein the wheeled frame includes a plurality of pair of wheels, the wheels of each pair are generally aligned with one another such that the wheels enable movement along a single axis, the wheels are mounted through openings in said first and second members to extend above and below the wheel frame;

wherein the winch includes a cable wound upon a spindle in mechanical communication with a motor; wherein the cable includes a hook for attachment to a roof ridge;

wherein the motor is in wired communication with a control switch that controls power from a powering means and which controls winding or unwinding of said spindle;

wherein the powering means comprises of at least one battery;

wherein the seat includes seat members that individually attach to opposing sides of the frame via a pivoting point on respective said first and second members; wherein pivoting means attaches to opposing sides of the frame; wherein the pivoting means comprising a pair of pivoting arms pivotally attached to respective seat members via locking pins;

wherein the first and second members on opposing sides of the frame each includes a plurality of frame holes for selectively attaching the pivoting arms thereto so as to adaptively select varying angles formed between the seat and the frame;

wherein the seat members each include a plurality of seat holes for attachment of the pivoting arms thereto.

* * * * *